US011292661B2

(12) United States Patent
Niederkofler et al.

(10) Patent No.: US 11,292,661 B2
(45) Date of Patent: Apr. 5, 2022

(54) PACKAGING ARRANGEMENT AND METHOD FOR PACKAGING

(71) Applicant: LOGICDATA Electronic & Software Entwicklungs GmbH, Deutschlandsberg (AT)

(72) Inventors: Haymo Niederkofler, Graz (AT); Mathias Bratl, Graz (AT)

(73) Assignee: LOGICDATA ELECTRONIC & SOFTWARE ENTWICKLUNGS GMBH, Deutschlandsberg (AT)

( * ) Notice: Subject to any disclaimer, the term of this patent is extended or adjusted under 35 U.S.C. 154(b) by 182 days.

(21) Appl. No.: 16/525,421

(22) Filed: Jul. 29, 2019

(65) Prior Publication Data

US 2020/0039734 A1 Feb. 6, 2020

(30) Foreign Application Priority Data

Aug. 6, 2018 (DE) ..... 102018119035.2
Oct. 25, 2018 (DE) ..... 102018126696.0

(51) Int. Cl.
*B65D 85/64* (2006.01)
*B65D 77/04* (2006.01)
*A47C 20/04* (2006.01)

(52) U.S. Cl.
CPC ..... *B65D 85/64* (2013.01); *B65D 77/042* (2013.01); *A47C 20/041* (2013.01); *B65D 2585/647* (2013.01)

(58) Field of Classification Search
CPC ..... B65D 85/64; B65D 2585/647; B65D 77/042; B65B 35/00; A47C 19/021; A47C 20/041; A47C 20/08
(Continued)

(56) References Cited

U.S. PATENT DOCUMENTS 5,964,347 A † 10/1999 Urness
6,990,698 B2 1/2006 Wall, Sr.
(Continued)

FOREIGN PATENT DOCUMENTS

DE 1803079 U 12/1959
DE 202004010064 U1 11/2005
(Continued)

OTHER PUBLICATIONS

Fedex, FedEx How-To-Pack-ZH-CN Packaging Guide, 2017, https://www.fedex.com/content/dam/fedex/apac-asia-pacific/downloads/fedex-how-to-pack-zh-cn.pdf.†

*Primary Examiner* — Luan K Bui
(74) *Attorney, Agent, or Firm* — Morgan, Lewis & Bockius LLP

(57) ABSTRACT

The disclosure relates to a packaging arrangement for storage and transport of electrically adjustable beds of a modular bed system which can be dismantled into individual components, the bed system being configured to form one or more different bed types which are different in terms of width and/or length. The beds are beds of a family of beds, comprise at least an upper leg sector, a lower leg sector, a seat sector and a torso sector, and have a plurality of bed plates for carrying a mattress. The packaging arrangement is suitable for accommodating a quantity of components of a single bed of each bed type of the bed system and the quantity of the components comprises at least the plurality of bed plates, at least one cross member and at least two longitudinal members. A width B of the packaging arrangement corresponds substantially to the width of a bed plate of a bed type, a length L of the packaging arrangement corresponds substantially to the length of one or the sum of the lengths of two bed plates of a bed type, and a base area of the packaging arrangement is substantially identical for all bed types of the bed system. A height H of the packaging
(Continued)

arrangement is given by: H≤/2, where G is a limit for length plus girth of the packaging arrangement.

22 Claims, 5 Drawing Sheets

(58) Field of Classification Search
USPC ..... 206/326, 576; 53/443
See application file for complete search history.

(56) References Cited

U.S. PATENT DOCUMENTS

| | | | | |
|---|---|---|---|---|
| 7,559,425 | B2 * | 7/2009 | Hsu | B65D 5/509 206/320 |
| 8,566,981 | B2 | 10/2013 | Connor, Jr. | |
| 9,782,013 | B2 | 10/2017 | Craver | |
| 2002/0103716 | A1 | 8/2002 | Wieland et al. | |
| 2005/0088028 | A1 | 4/2005 | Wan et al. | |
| 2005/0251917 | A1 | 11/2005 | Wall, Sr. | |
| 2008/0157640 | A1 * | 7/2008 | Chen | H02B 1/301 312/264 |
| 2008/0223738 | A1 * | 9/2008 | Voss | A47B 3/10 206/216 |
| 2008/0245697 | A1 * | 10/2008 | Lerner | B65D 5/324 206/525 |
| 2009/0301039 | A1 * | 12/2009 | Caputo | E06B 9/266 53/473 |
| 2010/0229303 | A1 | 9/2010 | Goldsmith | |
| 2015/0135646 | A1 † | 5/2015 | Goenka | |
| 2016/0374478 | A1 † | 12/2016 | Oh | |
| 2017/0208956 | A1 | 7/2017 | Rawls-Meehan et al. | |

FOREIGN PATENT DOCUMENTS

| | | | |
|---|---|---|---|
| DE | 102015122605 | A1 | 6/2017 |
| WO | WO-2017139374 | A1 | 8/2017 |
| WO | 2017194752 | A1 † | 11/2017 |
| WO | WO-2017194752 | A1 | 11/2017 |
| WO | WO-2017216547 | A1 | 12/2017 |
| WO | 2018040721 | A1 † | 3/2018 |

* cited by examiner
† cited by third party

PACKAGING ARRANGEMENT AND METHOD FOR PACKAGING

BACKGROUND OF THE INVENTION

The present disclosure relates to a packaging arrangement for beds of a bed system which can be dismantled into individual components, in particular for storage and transport, and to a method of packaging.

Shipping costs play an important role in the mail order business for furniture. Due to the surcharge guidelines of logistics companies, shipments with large packing dimensions often cause surcharges which contribute to a not inconsiderable proportion of the shipping costs of the total price of the furniture. In particular, furniture with significant dimensions, such as beds, are always packaged for transport in such a way that the limit length plus girth of the shipment for standard shipping is exceeded, and the surcharges mentioned thus considerably increase the shipping costs.

SUMMARY OF THE INVENTION

The present disclosure provides an improved concept for a packaging arrangement of beds, in particular of electrically adjustable beds, wherein the packaging arrangement complies with the shipping dimensions for standard shipping such that shipping surcharges are avoided.

The improved concept is based on the idea of providing a dismantable bed of a modular bed system which comprises beds of one or more different bed types which differ in width and/or length, and of developing a packaging arrangement for the different bed types which accommodates all components of the bed to be packaged while complying with the shipping dimensions for standard shipping.

A first aspect of the improved concept describes a packaging arrangement for the storage and transport of electrically adjustable beds of a modular bed system which can be disassembled into individual components, the bed system being designed to produce one or more different bed types which are different in width and/or length. The beds are of a family of beds and comprise at least one upper leg, one lower leg, one seat and one torso sector, and feature a plurality of bed plates for carrying a mattress.

According to the improved concept, the packaging arrangement is suitable for accommodating a quantity of components of a single bed of each bed type of the bed system. The quantity of components comprises at least the plurality of bed plates, at least one cross member and at least two longitudinal members. The torso sector comprises at least two of the bed plates which are either rigid or movable relative to each other. The longitudinal members and the cross member are not firmly connected to each other in the packaging arrangement, in particular not perpendicularly to each other.

A width B of the packaging arrangement corresponds substantially to the width of a bed plate of a bed type, a length L of the packaging arrangement corresponds substantially to the length of one or the sum of the lengths of two bed plates of a bed type and a base area of the packaging arrangement is substantially identical for all bed types of the bed system. For this purpose, the height H of the packaging arrangement is given by: $H \leq (G-L-2B)/2$ where G is a maximum length plus girth for standard shipping. "Substantially" means here and in the following that the dimensions described are identical except for usual tolerances or deviations that are negligible in relation to them, e.g. a packaging thickness. Usual tolerances and negligible deviations are in the low percentage range, for example a few mm to cm for lengths in the range of 1 m.

The bed system comprises beds of different bed types of a family of beds with different mattress sizes, such as TwinXL, Queen Size or King Size mattresses, which, except for possible variations in different countries, represent standardized sizes. For example, the dimensions of a bed of a certain type correspond essentially to the dimensions of the corresponding mattress. In other words, the base area of the bed corresponds essentially to the base area of the mattress. Each bed type from this bed system comprises at least two longitudinal members, at least one cross member and a plurality of sectors with bed plates. Apart from the dimensions, the bed types of a family of beds are identical or essentially identical.

The longitudinal members and at least one cross member are frame members which can be one-piece or multi-piece. One-piece in this context means that a frame member includes other components, such as arms and/or motors, that are inseparable from the frame member during transport and assembly or disassembly of the bed, for example by the user, and form an essentially inseparable unit with the frame member. In this context, however, multi-part means that a frame member consists of several parts which are brought into their final form by the user, for example. For example, loose parts could be put together to form a frame member, telescopically arranged parts could be pulled out or parts connected by angles could be folded apart. The longitudinal members and at least one cross member are not firmly connected to each other in the packaging arrangement. For example, the longitudinal members and at least one cross member are not connected to each other or are flexibly connected by means of hinges.

The sectors comprise at least an upper leg sector, a lower leg sector, a seat sector and a torso sector. The sectors may include subsectors; for example, the torso sector includes a back sector and a head sector. Similarly, sectors may be combined; for example, upper and lower leg sectors may be combined into one leg sector. If the head sector and the back sector or the upper and lower leg sector are combined, the result is an embodiment with three effective sectors. If the upper leg and lower leg sectors are separate sectors, there are at least 4 effective sectors. If the head and back sectors and the upper and lower leg sectors are separate sectors, 5 effective sectors are formed. In principle, more than 5 effective sectors could also be realized, for example typical slatted frames, which can bring further advantages in terms of packaging, but also complicates assembly. A further disadvantage are gaps between the effective sectors, which for optical and/or anti-squeeze reasons should preferably be minimized in their number and in relation to the distance. Several effective sectors may also lead to higher costs.

Each effective sector comprises a bed plate, with the bed plates serving as a support surface for a mattress. The bed plates can be rigid or movable in relation to each other. For example, the bed plate of the head sector can be adjusted relative to the bed plate of the back sector. The bed plates for a bed of a bed type differ essentially only in their width, whereby the width of a bed plate is defined as the extent which extends along the lying surface, i.e. the length, of the bed. For example, the bed plate of the back sector is wider than the bed plate of the head sector. The width of a bed plate is always smaller than its length, which is defined as the extension perpendicular to the length of the bed, i.e. along the width of the mattress. Such an arrangement of the bed plates results in the shorter side of the bed plate lying along the longitudinal member. In other words, the length of a bedplate determines the width of the bed and corresponds, for example, essentially to the width of the mattress.

The width of a bed plate cannot become arbitrarily small. Depending on the number of sectors for a bed type or the length of the bed of a bed type and the minimum permitted size of the gaps between the bed plates, certain minimum widths result, provided that the typical number of sectors is limited to 3-5. If more sectors are formed, as is the case with slatted frames, for example, narrower bed plates can be used.

Bed plates are not flush with the bed frame or with longitudinal and cross members. The areas of a bed plate that protrude from the bed frame, at the end faces or the transverse sides, are referred to as overhangs. Sensibly feasible overhangs range from a few cm to approx. 30-40 cm. In addition, the stiffness and strength of the panels limit the overhangs.

In some embodiments, the length of the longitudinal member is identical for all bed types. For long bed types, such as California King, the bed plates are mounted with a large overhang and the distances between the plates may be slightly larger than for shorter bed types.

The bed types differ essentially in the length of the cross members, width of the bed plates and in equipment features. For example, the bed plates can have different material, shape and/or colour. Typical designs of a bed plate include e.g. a wooden plate such as plywood, sandwich plate, solid wood plate and chipboard with steel substructure. The thickness of the bed plates depends on the material and cannot be arbitrarily thin for reasons of stability. Typical material of bed plates is wood with a thickness of 15-22 mm. The features of a bed include additional functions such as lighting, massage, etc.

The packaging arrangement according to the improved concept is designed in such a way that all components of a bed, especially the frame parts, can be packed compactly. On the one hand, this reduces the costs for filling elements for the packaging, on the other hand, the dimension limits for standard shipping of transport companies can be adhered to, which means that no surcharges are incurred due to oversizes. A further advantage of a compact packaging size is the space-saving storage, e.g. in an attic or in the basement of a customer, where storage space is often limited.

The dimensions of packaging for a bed cannot be arbitrarily small for a particular bed size and structural design. The dimensions are determined by the dimensions of the longitudinal members, cross members, bed plates and the number of sectors for a specific bed size. The challenge in designing minimal packaging is to make the best possible use of the volume of a package, for example by saving filling elements.

According to the improved concept, the width B of the packaging arrangement essentially corresponds to the width of a bed plate of a bed type. Accordingly, the length L of the packaging arrangement corresponds essentially to the length of one or the sum of the lengths of two bed plates of a bed type. For example, the length L essentially corresponds to the greater of the two lengths L1 and L2, where L1 is the length of the bed plate of the widest of the bed types and L2 is twice the length of the bed plate of the narrowest of the bed types. If the narrowest bed in a bed system is a twin bed 38 inches wide and the widest is a Super King bed 80 inches wide, then the minimum length L of the packaging arrangement is around 80 inches, plus packaging thickness and any filling elements. If, on the other hand, the widest bed were a Queen bed with a width of 60 inches, then the minimum length L would be around 2×38 inches=76 inches, plus packaging thickness and any filling elements.

Accordingly, the width B, for example, is the width of the widest of the bed plates of all bed types. This ensures that a base area of the packaging arrangement can be identical or essentially identical for all bed types of the bed system. Essentially, this means that the thickness of the packaging itself still has to be taken into account.

The height H of the packaging arrangement is then chosen, according to the improved concept, in such a way that the dimension limit standard shipping is adhered to, whereby the dimension limit is typically defined as the sum of the length L and the girth, i.e. the double width 2B and the double height 2H.

In some embodiments, the dimension limit is 130 inches, which corresponds to the dimension limit for standard shipping, especially from US transport companies. Especially in the mail order business, it is desirable to keep the shipping costs for the customer low or to avoid surcharges, which is why it is essential to adhere to said dimension limits.

In some embodiments, the length of each of the at least two longitudinal members in a packaging state corresponds at most to the greater of the two lengths L1 and L2, where L1 is the length of the bed plate of the widest of the bed types and L2 is twice the length of the bed plate of the narrowest of the bed types.

In such embodiments it is achieved that the length L of the packaging unit is not increased by at least two longitudinal members. For example, the at least two longitudinal members are arranged side by side in the packaging arrangement so that the length of the longitudinal members is essentially parallel to the length of the bed plates.

In some embodiments, each of the many bed plates for all bed types has one of two different widths.

In further embodiments, the plurality of bed plates for all bed types is equal to five.

In order to optimize the packaging dimensions, the width of the widest bed plate must be reduced and at the same time adjusted to the sum of the overall height of two adjacent longitudinal members. For typical beds with at least 4 sectors, i.e. separate upper and lower leg sectors, a seating sector and a torso sector, the torso sector has the widest bed plate.

An optimization of the torso sector with regard to optimal packaging size now consists of dividing the torso sector into a head sector and a back sector and using two separate bed plates: a head plate and a back plate. This means that one more bed plate has to be packed, but the maximum width is reduced and the packaging footprint is optimized.

The separation of the torso sector into the head and back sectors in order to achieve small bed plate widths and thus optimum conditions for minimum packing has the further advantage of being able to better support the head or neck area, in particular in an upright position of the torso sector, e.g. in a position used for watching television. On the other hand, such areas also serve to bend the mattress more evenly, resulting in less wear and tear, or to allow the user of the bed an ergonomically better position, especially when headrest and footrest are upright at the same time.

A further optimization step is achieved by reducing the width of the bed plates to two standard plate widths. The width of the head plate, the seat plate and the lower leg plate are identical and the width of the back plate and the upper leg plate are identical. This means that five sector plates in only two standard widths are required, which not only optimizes the packaging footprint but also facilitates the production of the plates. This means that only two different panel sizes per bed width have to be produced.

The bed plate widths considered optimal for packaging are ideal for the head and neck support functions mentioned above. The width of the narrow bed plate is between 200 and 300 mm, approximately 260 mm, while the width of the wide bed plate is between 350 and 450 mm, approximately 400 mm.

In addition to the division into head and back sectors, three-part torso sectors are also possible, in which a lumbar vertebra support is used, which is realized by its own narrow bed plate.

Previously known concepts often divide the bed frame approximately in the middle in order to get two halves of the same size. They do not divide the bed frame in the upper part of the torso sector, but in the middle part of the seating sector. The advantage of the present disclosure, on the other hand, is that the torso part of the body is divided rather than the seat sectors, so that only two panel widths are used for all types of bed in the bed system.

In some embodiments, the width of the widest of the bed plates essentially corresponds to the width of two adjacent longitudinal members lying on the side.

If the longitudinal members have a low overall height in cross section, for example in the 180-200 mm range, it is ensured that two longitudinal members next to each other are not wider than the width B of the packaging arrangement or the width of the widest of the bed plates.

In some embodiments, each of the at least two longitudinal members is symmetrical with respect to a plane of symmetry perpendicular to a main axis of extension of the respective longitudinal member.

In some embodiments, the at least two longitudinal members are arranged symmetrically to each other.

For further optimization of the packaging unit, the longitudinal members are not only arranged adjacent to each other symmetrically, but each longitudinal member itself is symmetrical, i.e. a shape of the head end of the longitudinal member corresponds to a shape of the foot end of the longitudinal member. On the one hand, this leads to a more attractive appearance of the assembled bed, but also has advantages in terms of packaging. Due to the symmetrical shape of the longitudinal members, the filling elements required to protect the longitudinal members in the packaging are also symmetrical. This means that many parts of the same shape (identical parts) can be used for the filling elements in the packaging, which reduces the manufacturing costs of the filling elements and facilitates packaging. In addition, the arrangement in the packaging appears optically neat.

In some embodiments, at least one longitudinal member has drives and mechanics for the adjustment of a plurality of sectors.

For an electrically adjustable bed, at least one longitudinal member has an adjustment mechanism for the adjustment of one or more sectors as well as corresponding integrated drives. In concrete terms, for example, each longitudinal member has two actuators and one longitudinal member has a central control system which controls the two longitudinal members or the actuators. However, it is also conceivable that only one longitudinal member has integrated drives and that the drive power is transmitted to the other side or to the other longitudinal member, e.g. by a torsion bar. Further possibilities are, for example, decentralized controls in each drive with a bus system between the controls for communication as in a network.

The adjusting mechanism of the longitudinal members consists of a series of joints and arms on which the bed plates are mounted. Both longitudinal members have mounting options for connection to the cross members, typically at the end of the longitudinal members and for connection to the bed plates.

In some embodiments, voids between the quantity of components are filled with filling elements.

Filling elements are needed on the one hand to protect the components during storage and transport. To achieve this, filling elements must have a good protective effect even at a minimum volume. Especially critical are impulse-like loads, e.g. during a drop test according to the ISTA-3A test by the International Safe Transit Association. In order to absorb the kinetic energy in a limited space, materials with good damping properties, high compressive strength and manufacturing processes are required which allow a precise adaptation to the shape of the components to be protected. Particularly suitable are e.g. moulded polystyrene or polyethylene packaging parts. An alternative to this are packaging parts made of fibre forms, colloquially also called "egg carton", which can be produced more ecologically at the expense of lower damping properties.

Filling elements also prevent components from slipping back and forth in packaging cavities, which can lead to damage during transport, especially during the drop and vibration tests mentioned above.

In further embodiments, the filling elements include storage for further accessories.

The above mentioned voids can be minimized by appropriate shaping of bed components or used for packing accessories, e.g. in the form of boxes for small parts. In the latter case, the boxes themselves serve as filling elements, but in contrast to normal filling elements they have the advantage that the space is used sensibly for packaging the accessories.

Optimal use of the internal volume of the packaging leads to a minimum volume that has to be filled with filling elements. The quantity and costs for filling elements are minimized. The minimum filling elements required serve to protect the components or to protect the components during transport and assembly, e.g. the filling elements serve to protect the adjustment mechanism during bed assembly so that neither the longitudinal member nor the floor are damaged if the longitudinal member falls over.

In some embodiments, the filling elements consist of symmetrical identical parts.

In such embodiments, it is achieved that many parts of the same shape, i.e. identical parts, are used as filling elements in the packaging, which in turn reduces the manufacturing costs of the filling elements and also facilitates packaging. In addition, an aesthetic improvement is achieved as the components and filling elements are arranged in a visually neat manner in the packaging.

In some embodiments, the bed plates are arranged one above the other and/or next to each other with respect to the base area.

An optimum packaging arrangement results when the bed plates are arranged one above the other, i.e. stacked. Due to the different widths of the bed plates, voids form when the bed plates are aligned flush on two sides, e.g. on one long and one short side of the bed plates. These voids can, for example, be used for stowing other components, in particular the cross member, which can be dimensioned in such a way that it optimally fills one of the voids. For example, for a narrow bed type, bed plates can also be arranged next to each other with regard to their base area.

In some embodiments, the packaging arrangement comprises two packaging units, which are arranged one above the other with respect to the base area.

Beds of the bed system always have a number of components that are identical for each bed type and those that are bed type-specific. An optimum packaging arrangement for such bed systems is achieved by packaging bed-type-independent components together in a first packaging unit, for example, in order to be able to produce and provide them in larger quantities. Bed type-dependent components can, however, be combined in a second packaging unit. In other words, in addition to bed-type-independent packaging, there is a plurality of bed-type-specific packaging with the respective components.

For example, a first packaging unit comprises a box containing at least two longitudinal members in a symmetrical arrangement as well as other components such as control, wiring, power supply and/or fasteners, which are identical for all bed types. Accordingly, an exemplary second packaging unit includes a box that holds those components that depend on the respective bed type, e.g. the width of the bed. These components include at least one cross member and a plurality of bed plates.

Both packaging units together form a unit and are transported together by a transport company, for example to a customer or user.

In further embodiments, the base areas of the packaging units are the same or essentially the same.

An essential characteristic of the packaging units in such a design is their base area. The base areas of the packaging units are identical so that the packaging units can be packed flush with each other. If, for example, they are arranged in an outer packaging, they cannot slip relative to one another in the packaging, especially in the case of impulse loads which cannot be ruled out during transport. If the base area were not identical, additional filling elements would have to be used, which is not optimal with regard to the resulting total volume and causes additional costs for the filling elements.

In particular, the bed type-specific or bed type-dependent packaging units also correspond in their respective base area to the base area of the bed type-independent packaging unit, although the bed types have different widths, for example. This means that all bed type-specific packaging units can always be combined with bed type-independent packaging units. In other words, all packaging units of all bed types in a bed system have the same or substantially the same base area.

In further embodiments, the packaging arrangement includes an outer packaging containing the two packaging units.

The outer packaging is, for example, a box into which cartons of the two packaging units are inserted flush. Alternatively, the outer packaging consists of a base on which the two packaging units are arranged one above the other or, if necessary, one next to the other, and a hood which is placed over the packaging units. Such outer packaging can in particular facilitate the packing and unpacking of packaging units.

Instead of two boxes in one outer packaging, one could alternatively use only one outer packaging in which there are two areas that are delimited by a carton insert and thus define the two packaging units. However, this eliminates the advantage of separate production and packaging of the bed type-specific and bed type-independent components of the bed.

In other embodiments, the packaging arrangement includes a strap adapted to hold the packaging arrangement together.

Instead of an outer packaging, the two packaging units, i.e. two cartons for example, can be joined together by means of a strap to avoid an outer packaging and possibly save costs.

However, a strap can also be used in addition to an outer packaging in order, for example, to protect the packaging arrangement more effectively against external influences.

In other embodiments, the two packaging units have the same or different heights and the sum of the heights H is at most (G−L−2B)/2.

An important aspect in designs with two packaging units is ensuring that the dimension limit for standard shipping is adhered to. For this purpose, it is guaranteed in particular that the height of the bed-type-dependent packaging units does not exceed the said dimension limit, together with the height of the bed-type-independent packaging unit and any outer packaging.

According to a second aspect, a method of electrically adjustable beds of a modular bed system which can be dismantled into individual components is revealed, whereby the bed system is designed to produce beds of several different bed types which are different in width and/or length. The beds are beds of a bed type, comprising at least an upper leg sector, a lower leg sector, a seat sector and a torso sector, and feature a variety of bed plates for supporting a mattress.

The method comprises arranging the components in packaging units and bundling the packaging units to form a packaging arrangement. The quantity of the components comprises at least one plurality of bed plates, at least one cross member and at least two longitudinal members, wherein the longitudinal members and the cross member are not fixedly connected to one another in the packaging arrangement, in particular not perpendicularly to one another. A width B of the packaging arrangement corresponds substantially to the width of a bed plate of a bed type and a length L of the packaging arrangement corresponds substantially to the length of one or the sum of the lengths of two bed plates of a bed type. Furthermore, a base area of the packaging arrangement is essentially identical for all bed types of the bed system and a height H of the packaging arrangement is given by: $H \leq (G-L-2B)/2$ where G is the dimension limit for standard shipping, i.e. length plus girth.

The assembly method according to the second aspect essentially allows the above-mentioned advantages. Further embodiments of the method result for the person skilled in the art from the described embodiments of the packaging arrangement.

BRIEF DESCRIPTION OF THE DRAWINGS

Further advantageous embodiments of the disclosure are explained in more detail in the following by means of figures. In the figures, identical or equivalent components are provided with identical reference signs (with or without suffixes). Characteristics already described with the help of reference signs are not necessarily provided with reference signs in all figures.

In the figures.

DETAILED DESCRIPTION

Figure 1:
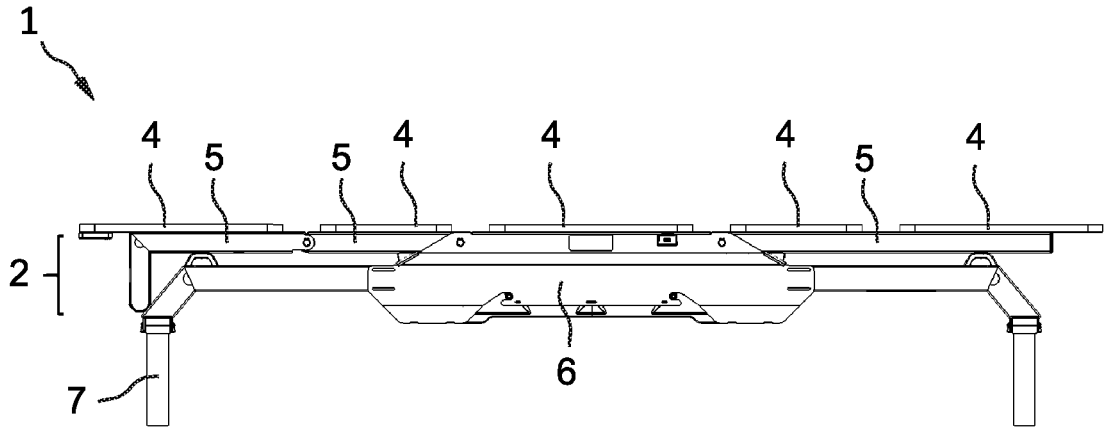
FIGS. 1 and 2 show different views of an exemplary dismantable bed of a modular bed system suitable for packaging according to the improved concept.
Figure 2:
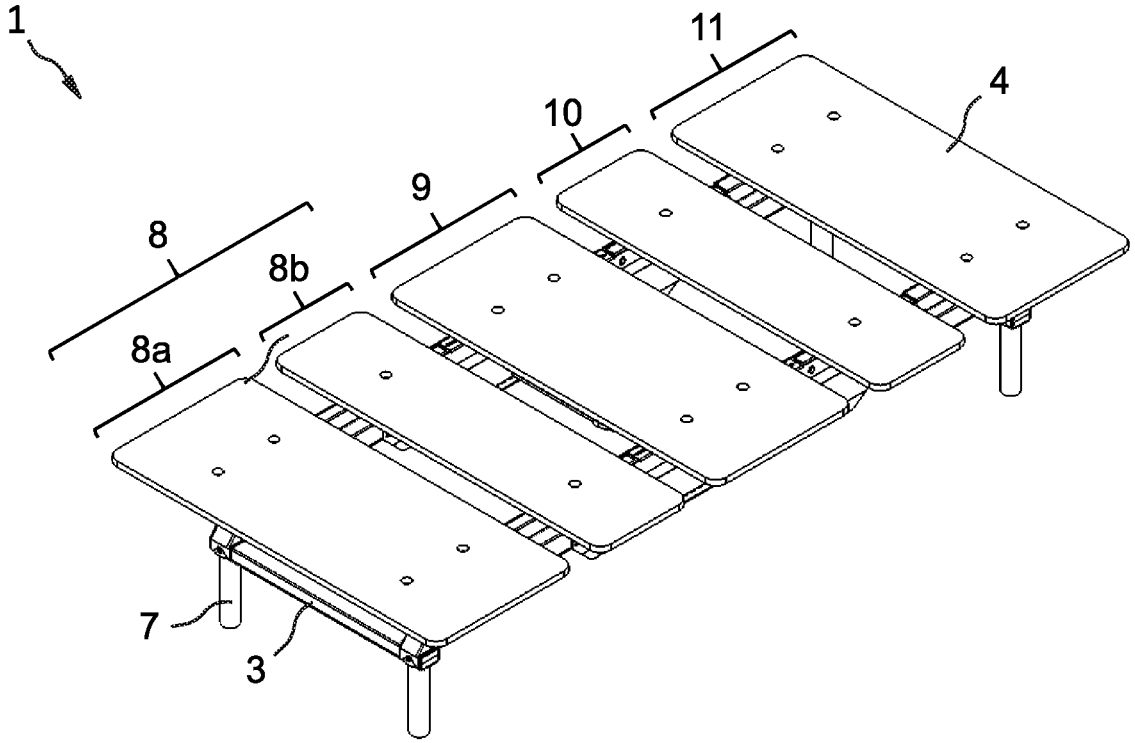

FIG. 1 shows a side view of a bed 1 of a modular bed system that can be dismantled into individual components. FIG. 2 shows an isometric view of the same bed 1.

The side view of FIG. 1 shows one of at least two longitudinal members 2 of bed 1, which comprises arms 5 of an adjustment mechanism 6 and the adjustment mechanism 6. Bed plates 4 are attached to the arms 5 of the longitudinal member 2. In addition, foot elements 7 are attached to the longitudinal member 2. The adjustment mechanism 6 of the longitudinal members 2 consists of a series of joints and arms 5 to which the bed plates 4 are attached. Both longitudinal members 2 have mounting possibilities for connection to at least one cross member 3, typically at one or both ends of the longitudinal members 2, and for connection to the bed plates 4. In some configurations only one of the longitudinal members 2 comprises an adjustment mechanism 6, which also controls the arms 5 of the second longitudinal member.

The isometric view in FIG. 2 shows the connection of the longitudinal members 2 by at least one cross member 3 and the subdivision of the supporting surface for the mattress by the bed plates 4 into different sectors 8-11. The lying surface is divided into a torso sector 8, a seating sector 9, an upper leg sector 10 and a lower leg sector 11. The torso sector 8 is divided into a head sector 8*a* and a neck sector 8*b*. Consequently, the exemplary bed 1 comprises five sectors that can be adjusted relative to each other by means of the adjustment mechanism 6, which can include a drive, in order, for example, to enable different lying or sitting positions for a user.

For reasons of stability, each of the bed plates 4 is one-piece, i.e. made of one piece. The width of a bed plate 4 is always smaller than the length of the bed plate 4. Since the bed plates 4 are arranged so that the shorter side of the bed plate 4 is parallel to the main axis of extension of the longitudinal member 2, the length of a bed plate 4 determines the width of the bed 1. Consequently, the length of the bed plates 4, and thus also the length of at least one cross member 3, can be adapted to standardized mattress sizes. The example in FIGS. 1 and 2 shows a bed 1 for a TwinXL mattress measuring 79.7 inches*37.2 inches. Other common mattress sizes include Queen Size (79.7 inches*58.3 inches), King Size (79.7 inches*74.4 inches) as well as the comparatively slightly longer California King size (82.5 inches*70.5 inches). As shown, the bed plates 4 are not flush with the bed frame or with longitudinal and cross members 2, 3. The resulting overhangs are typically in the range of 30-40 cm and are limited by the stiffness and strength of the bed plates 4.

The length of the longitudinal members 2 can be identical for all bed types. For long bed types, such as California King, the bed plates 4 are mounted with a larger overhang. In other words, the distances between the bed plates 4 are larger for long bed types than for shorter bed types. Wide bed types, such as the King Size bed type, in some designs include a third longitudinal member 2, e.g. arranged between the other two longitudinal members 2 for better support of the centre of the lying surface.

Figure 3:
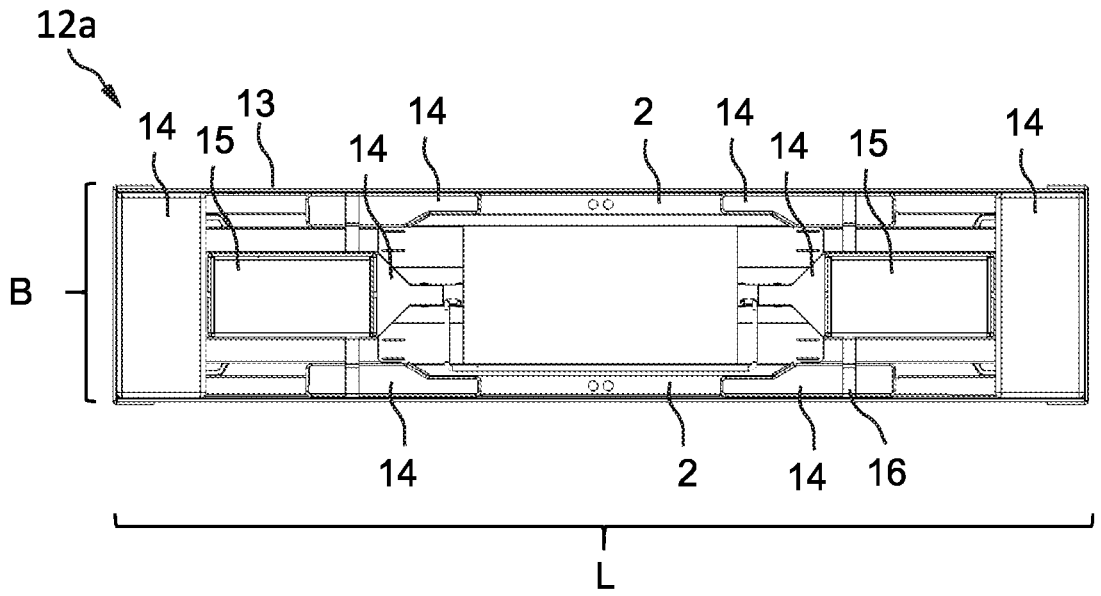
FIGS. 3 and 4 show different views of a first packaging unit according to the improved concept.
Figure 4:
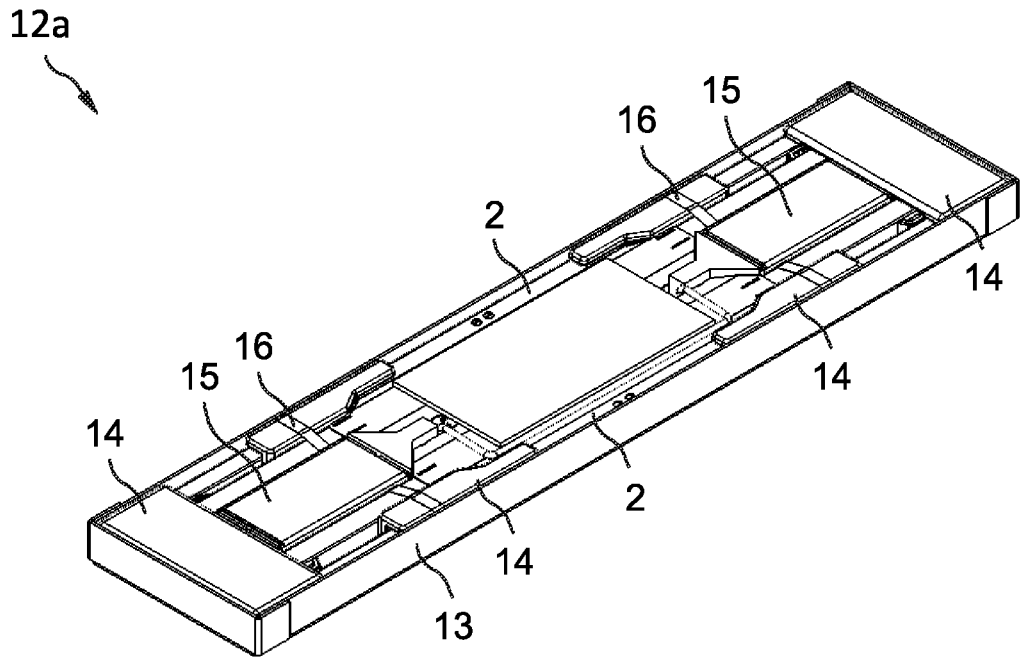

FIG. 3 shows a top view of a first packaging unit 12*a* of a packaging arrangement 12. FIG. 4 shows a corresponding isometric view. The first packaging unit 12*a*, for example, comprises all components of a bed 1 of a bed system that are independent of the bed type. Such components include, for example, the at least two longitudinal members 2, the adjusting mechanism 6 with drives and motors, as well as connecting elements. For example, the motors are integrated coaxially within the longitudinal members 2. As a result, the shape of the longitudinal member 2 on two of the six side faces is flat over the entire length and without protruding parts, allowing the longitudinal member 2 to be inserted flat in a package 13.

For the embodiment with one-piece longitudinal members 2, which cannot be further dismantled, the result is a long, narrow packaging 13 which has a negative effect on the surface. However, this long, narrow packaging has the advantage that it can be held more easily under the arm, for example, and can therefore be transported more easily by a single person than if it were square packaging that fits more easily on a pallet.

When designing the longitudinal member 2, it should be noted that the longitudinal member 2 has only a small dimension in the plane which includes the protruding arms 5 for the adjustment. In the side view of FIG. 1, the longitudinal member 2 has a low overall height, advantageously in the range of 150-200 mm. Thus two longitudinal members can be arranged next to each other on a surface that is not wider than the widest of the bed plates 4, which specifies the minimum width B of the packaging arrangement 12.

FIGS. 3 and 4 show a first packaging unit 12*a* of packaging arrangement 12. The essentially symmetrical arrangement of the longitudinal members 2 to each other in one plane can be seen. The longitudinal members are prevented from slipping by filling elements 14 in the voids of packaging 13 and by securing them with straps 16. In addition, some of the voids are filled with boxes 15, which may contain small components such as cabling, power supply units and fasteners. A length L of packaging unit 12*a*, except for the packaging thickness, is defined by the length of a bed plate of the widest bed type, e.g. King Size, or of two bed plates 4 of the narrowest bed type, e.g. TwinXL. As the first and second packaging units 12*a*, 12*b* preferably have an identical base area, the length of the first packaging unit is therefore longer than necessary, so that additional filling elements 14 may be necessary at the respective ends of the packaging 13, which may also be boxes 15.

Figure 5:
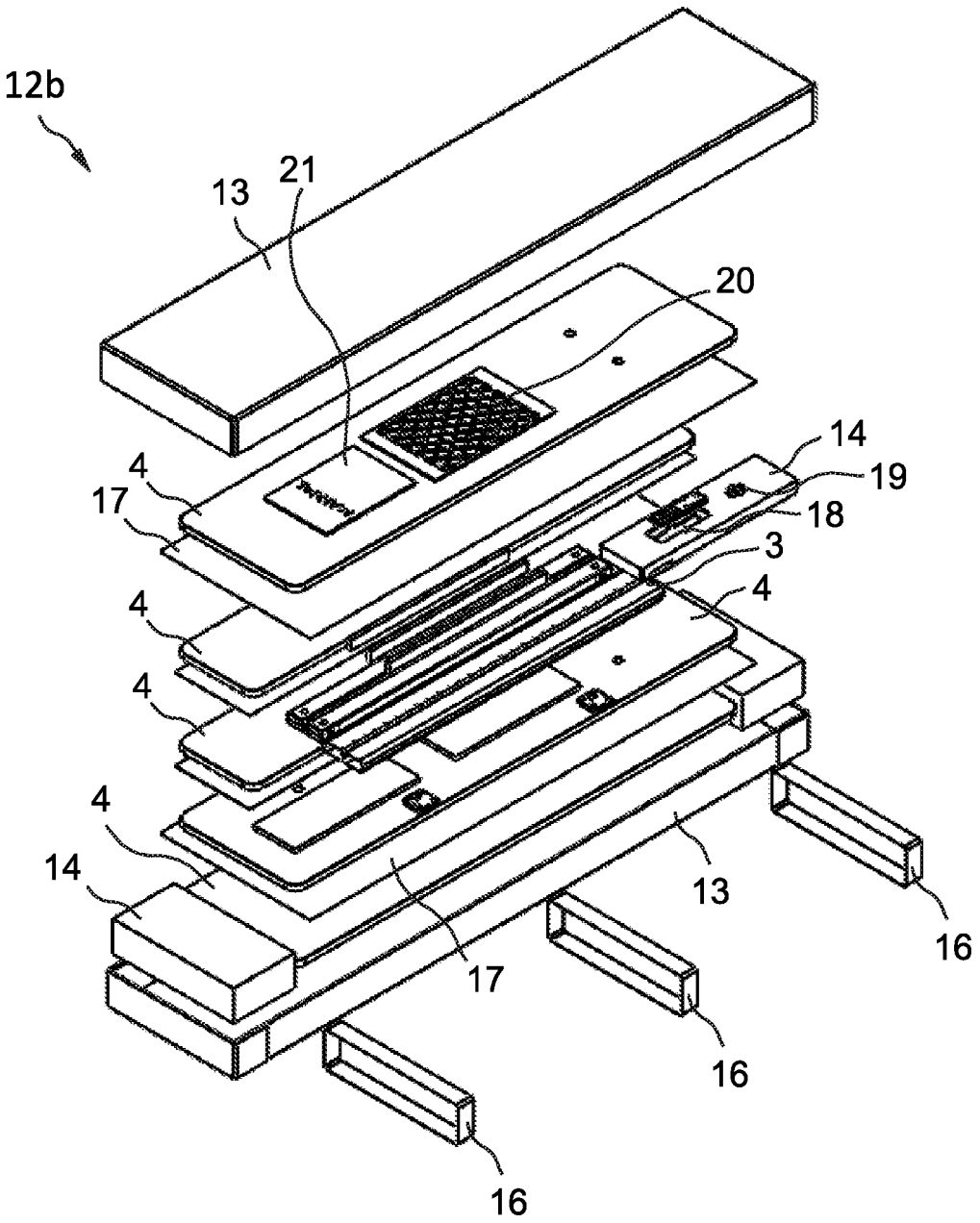
FIG. 5 shows an exemplary second packaging unit.

FIG. 5 shows an exploded view of an exemplary second packaging unit 12*b*. The second packaging unit 12*b*, for example, comprises all components of a bed 1 of a bed system that are dependent on the bed type. Such components include, for example, at least one cross member 3 and bed plates 4.

FIG. 5 shows how the packaging 13 of the second packaging unit 12*b* first contains two bed plates 4 with the larger width. The bed plates 4 with the smaller width are arranged above them, so that a narrow cavity is created in the packaging 13, which is filled with filling elements 14 and other components, such as the cross members 3, a remote control 18 and a battery 19. The third bed plate 4 with the larger width in packaging 13 serves as the top layer, which ensures additional protection of the components in the intermediate layer. This also results in a package that is more stable to external forces. Other flat components, such as a side pocket 20 and operating or assembly instructions 21 can be arranged on the surface course. Kraft paper 17 can be placed between the bed plates 4 to protect against damage.

The second packaging unit 12*b* with the bed plates 4 can be used as a support for the first packaging unit 12*a* or gives the latter additional stability and protection. The packaging 13 of the first packaging unit 12*a* and the second packaging unit 12*b* can each be closed with straps 16. Alternatively or additionally, an outer packaging or straps can fix the entire packaging arrangement 12 consisting of the first and second packaging units 12*a*, 12*b* together. The packaging arrangement is formed, for example, by stacking the first and second packaging units 12*a*, 12*b* and aligning them flush with each other. In other words, a base area of the first packaging unit 12*a* and a base area of the second packaging unit 12*b* are aligned congruently with each other. The total height H of the packing arrangement 12, i.e. the sum of the heights of the first and second packing units 12*a*, 12*b*, are always given by: $H \leq (G-L-2B)/2$ where G is the dimension limit for standard shipping, i.e. length plus girth.

Figure 6:
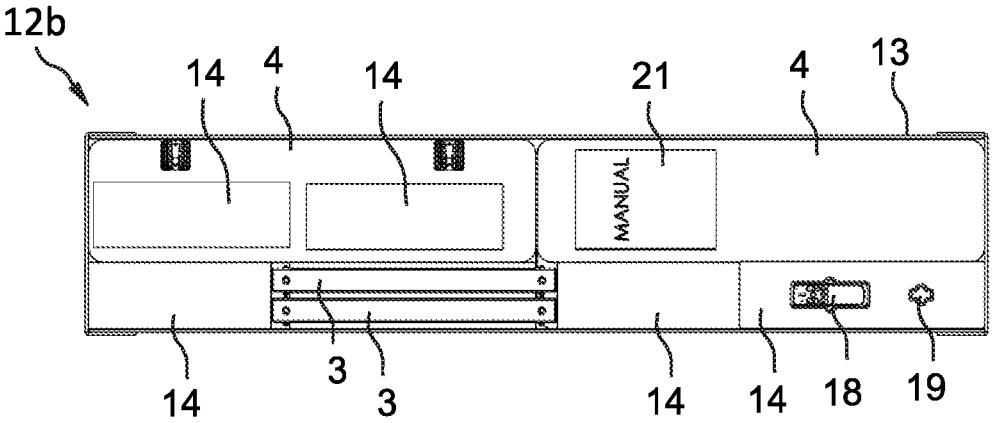
FIGS. 6 to 8 show second exemplary packaging units for different bed types of the bed system.
Figure 7:
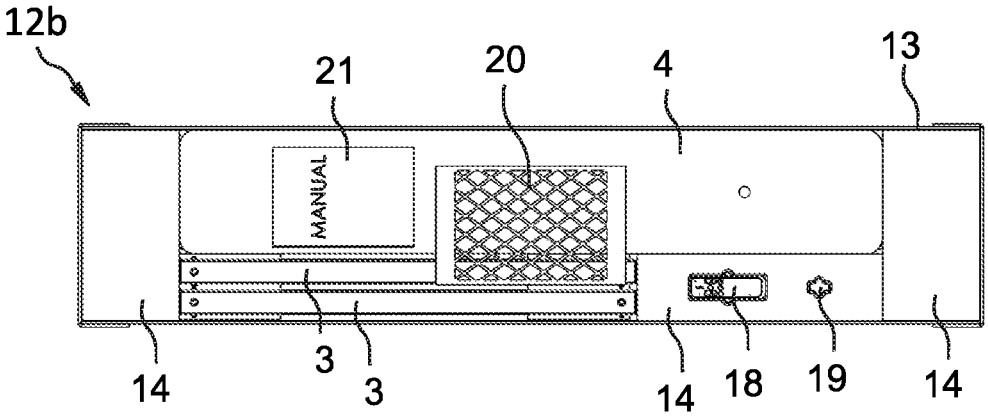
Figure 8:
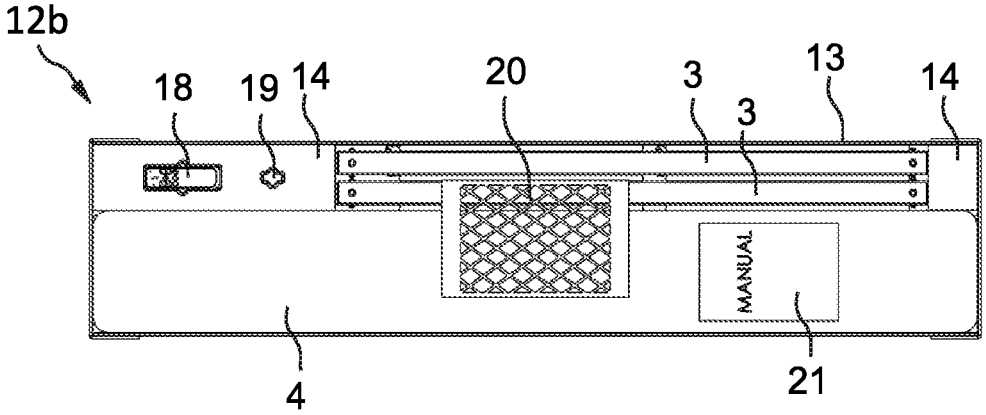

FIGS. 6 to 8 show different embodiments of the second packaging unit 12*b* for different bed types of the bed system. In detail, FIG. 6 shows an arrangement of the bed type dependent components of the TwinXL bed type, FIG. 7 of the Queen Size bed type and FIG. 8 of the King Size bed type. The figures show that the footprint of the second packaging unit 12*b*, which, moreover, essentially corresponds to the footprint of the first packaging unit 12*a*, is essentially identical for all bed types.

The optimum packaging size shows that in the cases of the TwinXL bed type and the King Size bed type, which is essentially twice as wide, no filling elements 14 are required on the end faces of the packaging, as the bed plates 4 make optimum use of the length L of the packaging 13.

Figure 9:
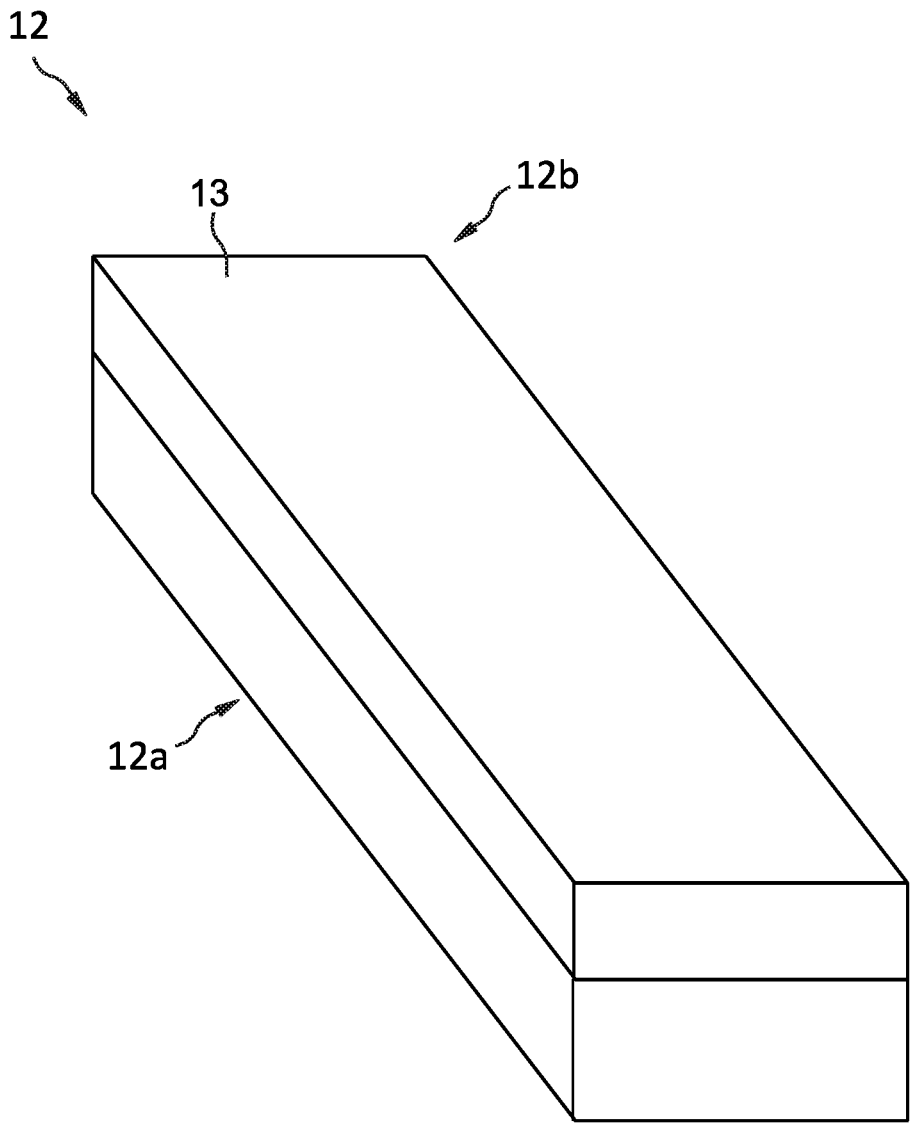
FIG. 9 shows an exemplary packaging arrangement comprising a first and a second packaging unit.

FIG. 9 shows an exemplary packaging arrangement 12 in which the packaging 13 of the first and second packaging units 12*a*, 12*b* are stacked and aligned flush with one another. The essentially same base area of the first and second packaging units 12*a*, 12*b* can be seen. An outer packaging and/or belts can be used to fix the packaging units 12*a*, 12*b* together for storage and transport in a material-saving way.

The figures show examples of packaging arrangement embodiments. Further embodiments deviating from the examples are possible according to the improved concept and result from the described embodiments. Various embodiments differ, for example, in the exact arrangement of the components in the packaging arrangement, in the number of packaging units and/or in the components of the bed system. For example, beds can have different numbers of sectors, bed plates, longitudinal members and/or cross members.

We claim:

1. A single bed of a family of beds and a packaging arrangement for storage and transport of the single bed, the family of beds comprising one or more different bed types that are different in width, in length, or in width and length, wherein the single bed is electrically adjustable, wherein the single bed:

comprises at least an upper leg sector, a lower leg sector, a seat sector and a torso sector; and is adapted to be dismantled into individual components, the packaging arrangement containing the individual components, wherein:

the individual components comprise at least one cross member, at least two longitudinal members, and a plurality of bed plates that are adapted for carrying a mattress;

the torso sector of the single bed comprises at least two of the plurality of bed plates that are either rigid or movable relative to each other; and the longitudinal members and the cross member of the single bed in the packaging arrangement are not firmly connected to one another, wherein:

a width B of the packaging arrangement substantially corresponds to a width of a bed plate of a bed type of the single bed;

a length L of the packaging arrangement substantially corresponds to a length of one bed plate or to a sum of lengths of two bed plates of the bed type of the single bed;

a base area of the packaging arrangement is substantially identical for all bed types of the family of beds; and a height H of the packaging arrangement is given by: $H \leq (G-L-2B)/2$, where G is a limit for length plus girth of the packaging arrangement, and wherein for the single bed, a direction of a length of each of the plurality of bed plates of the single bed is arranged along a direction of a width of the single bed, and the length of a bed plate of the plurality of bed plates of the single bed determines the width of the single bed.

2. The single bed and the packaging arrangement according to claim 1, wherein G is 130 inches.

3. The single bed and the packaging arrangement according to claim 1, wherein the width B of the packaging arrangement substantially corresponds to the width of the widest of the bed plates.

4. The single bed and the packaging arrangement according to claim 3, wherein the length of each of the at least two longitudinal members in a packaged state corresponds at most to the greater value of two lengths L1 and L2, where L1 is the length of the bed plate of the widest of the bed types and L2 is twice the length of the bed plate of the narrowest of the bed types.

5. The single bed and the packaging arrangement according to claim 1, wherein, for all bed types, each of the plurality of bed plates has a width selected from two different widths.

6. The single bed and the packaging arrangement according to claim 1, wherein, for all bed types, the plurality of bed plates includes exactly five bed plates.

7. The single bed and the packaging arrangement according to claim 1, wherein a width of the widest of the bed plates substantially corresponds to a width of two adjacent longitudinal members lying on a side.

8. The single bed and the packaging arrangement according to claim 1, wherein the bed plates have a thickness between 15 mm and 22 mm.

9. The single bed and the packaging arrangement according to claim 1, wherein each of the at least two longitudinal members are symmetrical with respect to a plane of symmetry perpendicular to a main axis of extension of the respective longitudinal member.

10. The single bed and the packaging arrangement according to claim 1, wherein the at least two longitudinal members are arranged symmetrically with respect to one another.

11. The single bed and the packaging arrangement according to claim 1, wherein each of said at least two longitudinal members have a maximum height between 180 mm and 200 mm.

12. The single bed and the packaging arrangement according to claim 1, wherein at least one longitudinal member comprises drives and mechanics for adjusting at least one of the upper leg sector, the lower leg sector, the seat sector and the torso sector.

13. The single bed and the packaging arrangement according to claim 1, wherein voids between a quantity of components are filled with filling elements.

14. The single bed and the packaging arrangement according to claim 13, wherein the filling elements comprise a storage for further accessories, and wherein the filling elements comprise symmetrical identical parts.

15. The single bed and the packaging arrangement according to claim 1, wherein the bed plates are arranged in a stacked manner, in a side-by-side manner, or in the stacked manner and the side-by-side manner with respect to the base area.

16. The single bed and the packaging arrangement according to claim 1, wherein the packaging arrangement comprises two packaging units arranged in a stacked manner with respect to the base area.

17. The single bed and the packaging arrangement according to claim 16, wherein the base areas of the packaging units are the same.

18. The single bed and the packaging arrangement according to claim 16, further comprising an outer packaging containing the two packaging units.

19. The single bed and the packaging arrangement according to claim 16, further comprising a strap adapted to hold the packaging arrangement together.

20. The single bed and the packaging arrangement according to claim 16, wherein the two packaging units have the same or different heights; and a sum of the heights is at most (G−L−2B)/2.

21. The single bed and the packaging arrangement according to claim 1, wherein for the single bed, the plurality of bed plates of the single bed are arranged in a single plane, and a length of the single bed is not less than the width of the single bed.

22. A method for forming a single bed of a family of beds and forming a packaging arrangement for storage and transport of the single bed, the family of beds comprising one or more different bed types that are different in width, in length, or in width and length, wherein the method comprises forming the single bed, wherein:

the single bed is electrically adjustable;

the single bed comprises at least an upper leg sector, a lower leg sector, a seat sector and a torso sector;

the torso sector of the single bed comprises at least two of a plurality of bed plates that are either rigid or movable relative to each other;

the plurality of bed plates are adapted for carrying a mattress; and the single bed is adapted to be dismantled into individual components, wherein the method comprises forming the packaging arrangement containing the individual components, wherein:

the individual components comprise at least one cross member, at least two longitudinal members, and the plurality of bed plates;

the longitudinal members and the cross member in the packaging arrangement are not firmly connected to one another;

a width B of the packaging arrangement substantially corresponds to a width of a bed plate of a bed type of the single bed;

a length L of the packaging arrangement substantially corresponds to a length of one bed plate or to a sum of lengths of two bed plates of the bed type of the single bed;

a base area of the packaging arrangement is substantially identical for all bed types of the family of beds; and a height H of the packaging arrangement is given by: $H \leq (G-L-2B)/2$, where G is a limit for length plus girth of the packaging arrangement, and wherein forming the single bed comprises:

arranging a direction of a length of each of the plurality of bed plates of the single bed, along a direction of a width of the single bed, wherein the length of a bed plate of the plurality of bed plates of the single bed determines the width of the single bed.

* * * * *